US005105940A

United States Patent [19]

Chen

[11] Patent Number: 5,105,940

[45] Date of Patent: Apr. 21, 1992

[54] RECEPTACLE

[75] Inventor: Ying-Che Chen, South El Monte, Calif.

[73] Assignee: Great Truth Co., Ltd., South El Monte, Calif.

[21] Appl. No.: 699,744

[22] Filed: May 14, 1991

Related U.S. Application Data

[63] Continuation-in-part of Ser. No. 530,624, May 30, 1990, Pat. No. 5,029,700.

[51] Int. Cl.[5] ..... B65D 85/72

[52] U.S. Cl. ..... 206/217; 206/315.1; 273/85 R

[58] Field of Search ..... D7/515, 536, 537, 608; 206/217, 315.9, 579; 215/1 R, 6, 99.5; 273/1 R, 1.5 R, 85 R; 446/74, 75, 77

[56] References Cited

U.S. PATENT DOCUMENTS

| | | | |
|---|---|---|---|
| 2,975,547 | 3/1961 | Greeve | 446/77 |
| 3,623,728 | 3/1969 | Goldfarb | 206/315.1 |
| 4,095,792 | 6/1978 | Kanno | 273/85 R |
| 4,362,299 | 12/1982 | Suzuki | 273/85 R |
| 4,678,093 | 7/1987 | Allen | 215/100 R |
| 4,848,773 | 7/1989 | Lovik | 273/85 R |
| 4,932,542 | 6/1990 | Chen et al. | 446/77 |

*Primary Examiner*—Jimmy G. Foster
*Attorney, Agent, or Firm*—Ladas & Parry

[57] ABSTRACT

A receptacle for containing and receiving things includes a wall body confining a primary receiving space to contain temporary contents in the wall body, and an enclosed section separated from the primary receiving space. The enclosed section has a transparent wall and at least one article is movably contained within it. A moving device is mounted on the wall body and is in communication with the enclosed section, for impelling the article.

3 Claims, 2 Drawing Sheets

RECEPTACLE

CROSS-REFERENCE OF RELATED APPLICATION

This invention is a continuation-in-part of the U.S. patent application Ser. No. 07/530,624 filed on May 30, 1990 which is now U.S. Pat. No. 5,029,700.

FIELD OF INVENTION

The invention relates to a receptacle, more particularly to a receptacle which can not only contain objects therein, but can also provide amusing effects for the user.

DESCRIPTION OF THE RELATED ART

The are various types of receptacle, such as cups, glasses, water canteens or even housing of pens and ball pens. Each one though can receive and contain things therein but can not provide amusing effects to a user. These receptacle look plain in appearance therefore some drawings or decorations are printed on the external surface so as to improve their appearance and look attractive. The drawings and printings are only aesthetic and lack entertaining effects.

SUMMARY OF THE INVENTION

It is therefore a main object of the present invention is to provide a receptacle which will serve not only as a container but also as an amusement.

Another object of the present invention is to provide a receptacle which includes a primary receiving space to contain the temporary contents in the receptacle, such as beverages, and an enclosed section which has a transparent wall and contains at least one movable article. The article can be impelled by a device disposed on the transparent wall of the enclosed section thus providing a source of amusement for the user..

In accordance with the present invention, a receptacle for containing and receiving things, includes a wall body having a projection extending inward from the internal wall surface to define a cavity extends inward into the projection and a transparent external wall disposed at the outer surface of the cavity. A plurality of movable articles are received inside the cavity. The movable article can be driven to float around by a moving device disposed on the wall body.

BRIEF DESCRIPTION OF THE DRAWINGS

Other features and advantages of the invention will become more apparent in the following detailed description, including drawings, all of which show a non-limiting form of the invention, and of which.

DETAILED DESCRIPTION OF THE PREFERRED EMBODIMENT

Figure 1:
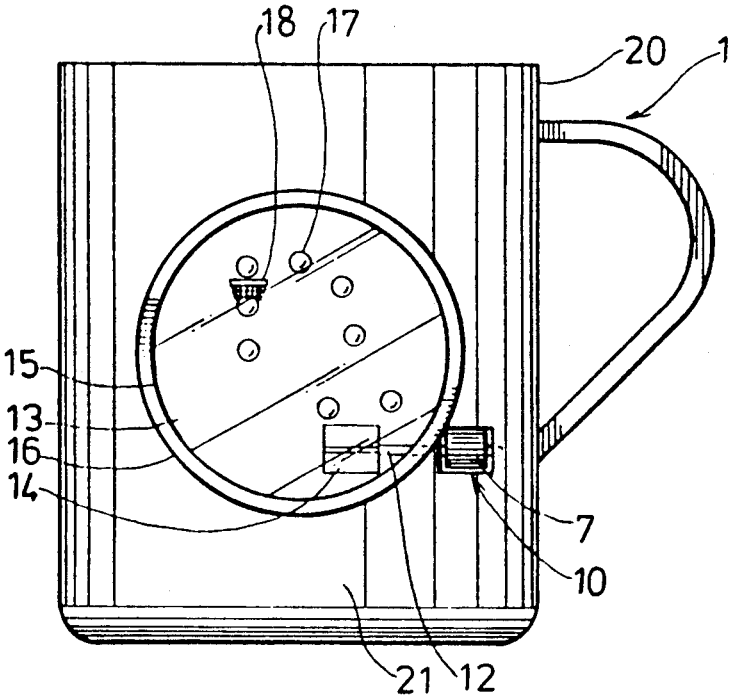
FIG. 1 is a side view of a first preferred embodiment of a receptacle of the present invention.

Referring to FIG. 1, a first preferred embodiment of the present invention is a cup 1 comprising a wall body 20 which confines a primary receiving space 21 for containing the temporary contents, and has a projection 13 extending inward from the internal wall surface thereof. An enclosed section 16 is formed in the projection 13 and a transparent wall 15 is disposed at the outer surface of the enclosed section 16 by means of a supersonic heat sealing process. A plurality of articles 17 are contained in the enclosed section 16 and a basket 18 including a net is fixedly mounted in the enclosed section 16.

An inlet (not shown in the Figure) for letting water into the enclosed section 16 is disposed at a position on the transparent wall 15 and a moving means 10, such as a roller 7, is disposed in the wall body 20 and is in communication with the enclosed section 16. The roller 7 has a free end extending into the enclosed section 16, on which are mounted a plurality of blades 14. The articles 17 will move about in the enclosed section 16, when the holder of the receptacle spins the roller so as to impel the articles 17. Thus, the receptacle 1 can contain not only the temporary contents but can also provide an entertaining effect for the user of the cup.

Figure 2:
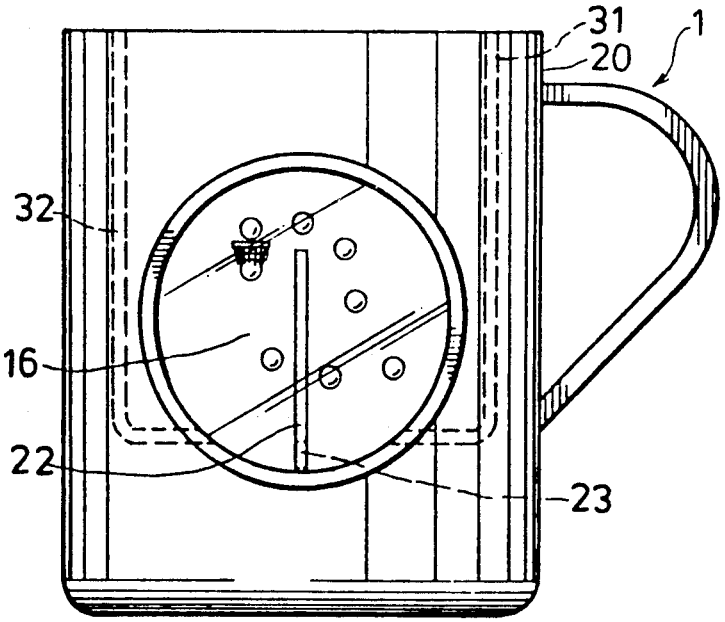
FIG. 2 is a side view of a second preferred embodiment of a receptacle of the present invention.

In one embodiment of the invention, the enclosed section 16 of the receptacle 1 includes a partition 22 with a through-hole 23 provided in the central portion of the enclosed section 16. The through-hole is wide enough for the article 17 to pass through it. The moving means in this embodiment is a couple of pipes 31, 32 each having a first end extending into the enclosed section 16 and a second end extending out of the wall body 20. A game can be played by blowing into the extending ends of the pipes 31, 32 to see who can throw the mast articles 17 through that through-hole 23 or into the basket within a given period, as shown in FIG. 2.

Figure 3:
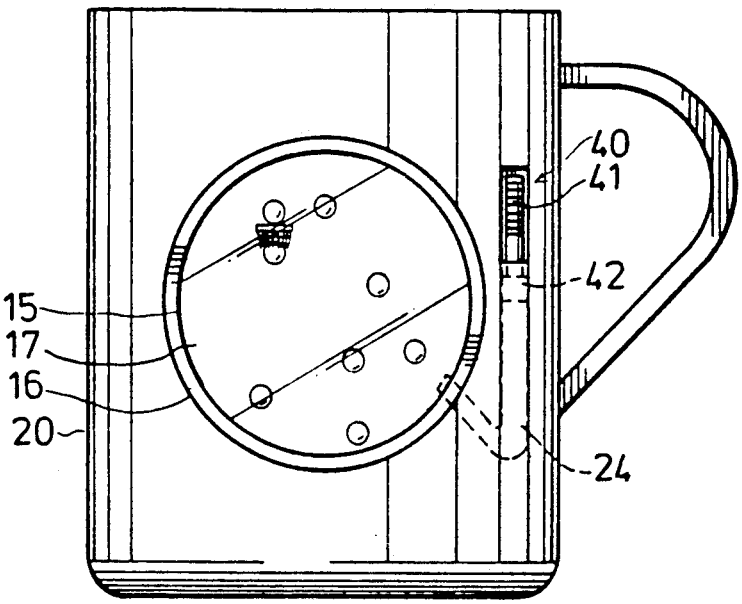
FIG. 3 is a side view of a third preferred embodiment of a receptacle of the present invention.

In another embodiment, the moving means 40 includes a pipe 24 having one end extending into the enclosed section 16 and another end in the wall body. A pushing rod 41 is disposed in the wall body 20 and has a piston 42 at one end, which piston extends into the other end of the pipe, as shown in FIG. 3. When the push rod 41 moves downward, the piston 42 hermetically expells the air in the pipe 24, so that the article 17 contained therein will float in the enclosed section 16 of the receptacle.

With the invention thus explained, it is obvious to those skilled in the art that various modifications and variations can be made without departing from the scope and spirit if the present invention. It is therefore intended that this invention be limited only as indicated in the appended claims.

I claim:

1. A receptacle for receiving and containing things, comprising:

a wall body confining a primary receiving space to contain the temporary contents of said receptacle, and an enclosed section separated from said primary receiving space, said enclosed section having a transparent wall;

at least one article movably contained inside said enclosed space; and means for moving said article, said moving means comprising a roller having a shaft, the free end of which shaft extends into said enclosed section, the free end of said shaft also having a plurality of blades mounted thereon.

2. A receptacle for receiving and containing things, comprising:

a wall body confining a primary receiving space to contain the temporary contents of said receptacle, and an enclosed section separated from said primary receiving space, said enclosed section having a transparent wall;

at least one article movably contained inside said enclosed space; and wherein:

said enclosed section further has a partition provided in the central portion thereof;

said partition has a through-hole big enough to pass said article; and means for moving said article said moving means is a pipe having a first end extending to said enclosed section and a second end extending out of said wall body.

3. A receptacle for receiving and containing things, comprising:

a wall body confining a primary receiving space to contain the temporary contents of said receptacle, and an enclosed section separated from said primary receiving space, said enclosed section having a transparent wall;

at least one article movably contained inside said enclosed space; and means for moving said article wherein said moving means includes a pipe having a first end extending into said enclosed section, a second end extending in said wall body, and a push rod disposed in said wall body, said push rod having a piston extending into said second end of said pipe.

* * * * *